US005906973A

United States Patent [19]

Ouzounis et al.

[11] Patent Number: 5,906,973

[45] Date of Patent: May 25, 1999

[54] PROCESS FOR CLEANING VERTICAL OR INCLINED HARD SURFACES

[75] Inventors: Dimitrios Ouzounis, Krefeld; Wolfgang Nierhaus, Moers, both of Germany

[73] Assignee: Henkel-Ecolab GmbH & Co. OHG, Duesseldorf, Germany

[21] Appl. No.: 08/894,122

[22] PCT Filed: Jan. 31, 1996

[86] PCT No.: PCT/EP96/00380

§ 371 Date: Aug. 11, 1997

§ 102(e) Date: Aug. 11, 1997

[87] PCT Pub. No.: WO96/24654

PCT Pub. Date: Aug. 15, 1996

[51] Int. Cl.[6] ..... C11D 1/75; C11D 3/22; C11D 3/43

[52] U.S. Cl. ..... 510/503; 510/119; 510/123; 510/235; 510/237; 510/243; 510/245; 510/362; 510/363; 510/356; 510/432; 510/470; 510/238; 510/242

[58] Field of Search ..... 510/119, 123, 510/235, 237, 243, 245, 362, 363, 356, 432, 470, 503, 238, 242

[56] References Cited

U.S. PATENT DOCUMENTS

| | | | |
|---|---|---|---|
| 4,154,706 | 5/1979 | Kenkare et al. | 252/547 |
| 4,483,779 | 11/1984 | Llenado et al. | 252/135 |
| 4,599,188 | 7/1986 | Llenado | 252/174.17 |
| 4,668,422 | 5/1987 | Malik et al. | 252/174.17 |
| 4,780,250 | 10/1988 | Urfer et al. | 252/547 |
| 5,019,280 | 5/1991 | Caswell et al. | 252/8.8 |
| 5,025,069 | 6/1991 | Deguchi et al. | 252/174.17 |
| 5,154,850 | 10/1992 | Deguchi et al. | 252/174.17 |
| 5,389,282 | 2/1995 | Saijo et al. | 252/174.17 |
| 5,422,031 | 6/1995 | Nomura et al. | 252/174.17 |
| 5,637,758 | 6/1997 | Sajic et al. | 560/147 |

FOREIGN PATENT DOCUMENTS

| | | |
|---|---|---|
| 0 075 996 | 4/1983 | European Pat. Off. . |
| 0 265 979 | 5/1988 | European Pat. Off. . |
| 0 314 232 | 5/1989 | European Pat. Off. . |
| 0 595 590 | 5/1994 | European Pat. Off. . |
| WO86/05199 | 9/1986 | WIPO . |
| WO94/28108 | 12/1994 | WIPO . |
| WO95/02664 | 1/1995 | WIPO . |

OTHER PUBLICATIONS

Ullmann's Encyclopedia of Industrial Chemistry 5(A8): 350–57 (1987).

*Primary Examiner*—Mark Kopec
*Assistant Examiner*—Charles Boyer
*Attorney, Agent, or Firm*—Ernest G. Szoke; Wayne C. Jaeschke; Norvell E. Wisdom, Jr.

[57] ABSTRACT

Aqueous detergents that thicken when mixed with water contain a combination of at least one tertiary amine oxide, at least one alkyl polyglycoside, and at least one water-soluble organic solvent. Also disclosed is the use of these detergents for cleaning hard surfaces.

20 Claims, No Drawings

PROCESS FOR CLEANING VERTICAL OR INCLINED HARD SURFACES

BACKGROUND OF THE INVENTION

This invention relates generally to the cleaning of hard surfaces in the industrial, social or communal sectors such as, for example, the cleaning of surfaces in the food industry, in canteens, swimming baths, warehouses, etc. More particularly, the invention relates to a cleaning formulation which thickens when mixed with water so that, after manual application or after application by spray or foam applicators, the contact time of the formulation on vertical or inclined surfaces is increased, so that its cleaning effect is enhanced. After the intended contact time, the formulation can be rinsed off with water.

Particular interest attaches to low-viscosity and, hence, readily pumpable cleaning concentrates which, on dilution with water, undergo an increase in viscosity to the in-use concentration and, in addition, build up a yield value which is particularly desirable. This enables the low-viscosity concentrate to be diluted with water immediately before application to the surfaces to be cleaned so that a thickened cleaning solution which adheres well to inclined or vertical surfaces is formed. The mixing process preferably takes place in a mixing nozzle from which the cleaning solution to be thickened is applied to the surfaces to be treated in the form of a film or a foam.

EP-B-265 979 describes thickening compounds for the preparation of thickened, aqueous single-phase cleaning formulations consisting of 0.1 to 10% by weight of a surfactant, for example a tertiary amine oxide, and of 0.01 to 3% by weight of an organic anionic sulfonate. EP-A-595 590 describes aqueous concentrates which produce a viscous cleaning solution when diluted with water and which contain tertiary amine oxides, sulfate- or sulfonate-based anionic surfactants, hydrophobicized polymer surfactants, diluents such as, for example, lower alcohols or lower alkyl ethers and alkalis. EP-A-314 232 discloses aqueous mixtures which undergo an increase in viscosity when diluted with water and which contain, for example, an amine oxide, an anionic surfactant, non-surface-active compounds ionizable in water and also water.

WO 86/05199 describes a cleaning formulation for hard surfaces which contains a combination of an alkyl polyglycoside with, for example, tertiary alkylamine oxides. This cleaning formulation does not contain a water-soluble organic solvent based on alcohol or glycol ether and does not thicken when diluted with water. EP-A-75 996 discloses a laundry detergent composition which contains 1 to 90% of an alkyl polysaccharide, 1 to 90% of a nonionic surfactant, for example a tertiary amine oxide, 0 to 90% by weight of a detergent builder and 0.01 to 2% of an anionic optical brightener. This known formulation also contains no organic solvent and does not have any thickening properties, which would actually be a disadvantage in the washing of laundry.

BRIEF SUMMARY OF THE INVENTION

The problem addressed by the present invention was to provide a new low-viscosity cleaning concentrate which would undergo an increase in viscosity when diluted with water.

The present invention relates to aqueous cleaning formulations containing amine oxide which can be thickened by adding water, characterized in that they contain:

a) 0.5 to 10% by weight of one or more tertiary amine oxides corresponding to general formula (I):

(I)

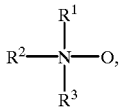

in which $R^1$ is a saturated or mono- to tri-unsaturated alkyl moiety containing 10 to 20 carbon atoms and $R^2$ and $R^3$ independently of one another represent methyl, ethyl or propyl moieties or hydroxy derivatives thereof;

b) 0.5 to 10% by weight of one or more alkyl polyglycosides corresponding to general formula (II):

$$R^4—O—(R^5—O)_y(Z)_x, \quad \text{(II)}$$

in which $R^4$ is a monofunctional saturated or unsaturated alkyl or hydroxyalkyl moiety containing 6 to 30 carbon atoms or an aryl moiety, $R^5$ is a difunctional hydrocarbon radical containing 2 to 4 carbon atoms, y is a number of 0 to 12, Z is a sugar moiety containing 5 or 6 carbon atoms and x is a number of 1 to 10;

c) 1 to 15% by weight of one or more water-soluble organic solvents selected from the group of monohydric or polyhydric alcohols, glycol ethers and alkanolamines and for the balance water or an aqueous solution of other auxiliaries and active substances.

DETAILED DESCRIPTION OF THE INVENTION

The individual components used in the composition according to the invention are known as ingredients of cleaning formulations and cleaning concentrates. For example, amine oxides of general formula (I) suitable for use in accordance with the invention are mentioned in WO 86/05199. Examples include lauryl dimethylamine oxide, myristyl dimethylamine oxide or amine oxides, where $R^1$ stands for a mixture of saturated or mono- or polyunsaturated alkyl moieties such as are present in and can be recovered from fats of natural origin. Amine oxides in which $R^1$ stands for a mixture of alkyl moieties of oleochemical origin are preferred for the purposes of the invention. Particularly preferred amine oxides are those in which the substituents $R^2$ and $R^3$ are 2-hydroxyethyl moieties. Examples of such amine oxides are bis-(2-hydroxyethyl)-cocoamine oxide, bis-(2-hydroxyethyl)-tallow amine oxide and bis-(2-hydroxyethyl)-stearylamine oxide.

Alkyl polyglycosides are a relatively new class of nonionic surfactants of which the alkyl moieties emanate from native fats, oils or petrochemically produced alcohols while their sugar moieties emanate from hydrolyzed polysaccharides. Alkyl polyglycosides are etherification products of fatty alcohols of oleochemical or petrochemical origin with mono- or oligo-saccharides. The sugar units may additionally be alkoxylated before etherification with the fatty alcohols. Alkyl polyglycosides of general formula (II), which are described in detail in WO 86/05199 for example, are obtained in this way. Technical alkyl polyglycosides are generally not molecularly uniform products, but represent alkyl ethers of mixtures of monosaccharides and different oligosaccharides. Alkyl polyglycosides (also referred to in short as APG's) which are based on non-ethoxylated sugars, i.e., in which y in general formula (II) is 0, are preferred for the purposes of the invention. A glucose moiety which is present as a sole glucose moiety or as an oligoglucose moiety containing up to about five glucose moieties is preferably used as the sugar moiety Z. The alkyl substituent $R^4$ is preferably a saturated or unsaturated alkyl moiety containing 8 to 16 carbon atoms and preferably 8 to 10 carbon atoms or a mixture of such alkyl moieties.

The solvents of group c) are generally mono- or polyfunctional alcohols, alkanolamines or glycol ethers, provided that they are miscible with water in the concentration range mentioned. The solvent is preferably selected from ethanol, n- or i-propanol, butanols, glycol, propane or butanediol, glycerol, diglycol, propyl or butyl diglycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol methyl or ethyl ether, methoxy, ethoxy or butoxy triglycol, 1-butoxyethoxy-2-propanol, 3-methyl-3-methoxybutanol, propylene glycol t-butyl ether and mono-, di- and tri-ethanolamine and mixtures of these solvents.

The concentrations of the components essential to the invention are preferably selected so that the ratio by weight of component a) to component b) to component c) is of the order of 3:(1 to 5):(1 to 10).

Depending on the intended application, the cleaning formulation according to the invention may contain other components, for example alkalis, chelating agents, builders, other anionic and/or nonionic surfactants, enzymes, preservatives, dyes and/or perfumes.

Suitable alkalis are, for example, sodium or potassium hydroxide, sodium or potassium carbonate and sodium or potassium silicates. Suitable chelating agents are, for example, alkali metal salts of ethylene diamine tetraacetic acid (EDTA) or nitrilotriacetic acid (NTA) and alkali metal salts of anionic polyelectrolytes, such as polyacrylates, polymaleates and polysulfonates. Low molecular weight hydroxycarboxylic acids, such as citric acid, tartaric acid, malic acid or gluconic acid, are also suitable. Other suitable chelating agents are organophosphonates such as, for example, 1-hydroxyethane-1,1-diphosphonic acid, aminotri (methylenephosphonic acid), hexamethylenediamine tetra (methylenephosphonic acid), diethylenetriamine penta (methylenephosphonic acid) and 1-phosphonobutane-1,2,4-tricarboxylic acid.

The chelating agents mentioned above, more particularly the polycarboxylates, may also be used for their builder properties. In addition to surfactants, builders are important components of detergents and cleaning formulations, cf. for example *Ullmann's Encyclopedia of Industrial Chemistry,* 5th Edition, Vol. A8 (1987), pages 350 to 357. They perform at least one of the following functions: alkalization of the cleaning formulation, binding of water hardness and soil dispersion. Known builders which may be used for the purposes of the present invention are monomeric and oligomeric phosphates such as, for example, monophosphates, pyrophosphates, tripolyphosphates and cyclic or polymeric metaphosphates. Other groups of inorganic builders include carbonates, hydrogen carbonates, borates and silicates, preferably those with a molar $SiO_2$ to $M_2O$ (M=alkali metal) ratio of 0.5 to about 4:1 and, more particularly, about 1.0 to about 2.4:1. Organic builders may advantageously be selected from the polymers and copolymers of acrylic acid, α-hydroxyacrylic acid, maleic acid and allyl alcohol. Poly (tetramethylene-1,2-dicarboxylates) and poly(4-methoxytetramethylene-1,2-dicarboxylates) may also be used. The inorganic and organic builders mentioned are used in the form of their water-soluble salts, more particularly their sodium or potassium salts.

Other anionic or nonionic surfactants which may be additionally used in the formulation according to the invention are, for example, alkyl sulfates and sulfonates and alkyl benzene sulfonates of oleochemical or petrochemical origin and alkoxylation products of fatty alcohols or fatty amines. The alkoxylates may be end-capped by alkyl moieties, for example butyl moieties, and may be present as fatty alcohol or fatty amine oligoglycol ethers. The foaming behavior of the cleaning formulations according to the invention can be controlled in this way.

The present invention also relates to the use of the cleaning formulation according to the invention, which formulation as such represents a concentrate and which is diluted with water for use in cleaning hard surfaces, for example unpainted, painted or enamelled metal surfaces or surfaces of plastics or ceramics, for example tiles. The cleaning formulation is particularly designed for the cleaning of large areas as encountered, for example, in the food and beverage industry, in canteens, warehouses, abattoirs, swimming baths or similar facilities. For application, the cleaning formulation according to the invention is diluted with water by a factor of about 10 to about 50; in other words the formulation is applied in a concentration of around 2 to around 10% by weight. When diluted with water in this way, the cleaning formulation according to the invention undergoes an increase in viscosity by a factor of at least about 2 and preferably by a factor of 5 to more than 10. The purpose of the invention is achieved in this way, i.e. although the formulation as a concentrate is readily pumpable, it undergoes an increase in viscosity on dilution to the in-use concentration and, accordingly, adheres to the surfaces to be cleaned for longer periods.

Mixing with water is preferably carried out using a mixing nozzle to which the cleaning formulation and the water are separately delivered in the desired quantity ratio. The cleaning formulation mixed with water in the nozzle is sprayed onto the surfaces to be cleaned and is foamed by the additional supply of air to the mixing nozzle. During its application, the cleaning formulation undergoes the required increased in viscosity. After the end of the contact time, the cleaning formulation diluted with water can be rinsed off the cleaned surfaces with water.

Alternatively, mixing of the cleaning formulation with water can take place in a mixing vessel, after which the thickened solution may be applied, for example manually, to the surfaces to be cleaned, for example using a cloth, a sponge, a brush, a spray bottle or a roller. This method of application is particularly suitable for cleaning small areas, for example in the home. In this case, the thickened cleaning formulation mixed with water may be used, for example, as a manual dishwashing detergent, as a floor cleaner, as a multipurpose cleaner, as a bath cleaner, as an oven cleaner or for similar purposes. However, it may also be used as the basis for foam baths, for shower gels and handwashing gels and the like.

Table 1 contains a selection of formulations according to the invention and comparison formulations. Table 2 shows the viscosities of the formulations in their original composition and after dilution with water by a factor of 10 and a factor of 20, i.e. as 10% and 5% aqueous preparations. The viscosities were measured at a sample temperature of 20° C. using a Brookfield digital viscosimeter, Model LVTDV-II; spindle No. 1 (LV Series Code Number 61); spindle speed 30 r.p.m.

Table 2 makes it clear that only the formulations according to the invention which contain at least the three main components a), b) and c) have low viscosities as such and clearly thicken when water is added. By contrast, the comparison formulations have high viscosities as such, which makes them difficult to pump, and clearly undergo a reduction in viscosity when diluted with water.

TABLE 1

(Composition in % by weight)

| Components | Comp.1 | Comp.2 | Comp.3 | Comp.4 | Comp.5 | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|---|---|---|---|---|
| A* | 6 | 6 | 6 | 6 | 6 | 6 | 6 | 6 | 6 | 6 | 6 | 20 | 20 | 1 | 20 |
| B* | | 5 | | | | 3 | 4 | 4 | 4 | 4 | 4 | 13 | 13 | 0.6 | 1 |
| C* | | | | | | | | | | | 4 | | | | |
| Butyl diglycol | | | 2 | | | | | 2 | 2 | | | | | | |
| i-Propanol | | | | 8 | | 8 | 2 | 2 | 2 | | | 10 | | 0.5 | 10 |
| Ethanol | | | | | 8 | | | | | 8 | | | | | |
| Triethanolamine | | | | | | | | | | | | | 10 | | |
| Sodium hydroxide, 50% | | | | | | | | | 15 | | | | | | |
| Deionized water | 94 | 89 | 92 | 86 | 86 | 83 | 88 | 86 | 71 | 82 | 86 | 57 | 57 | 87.9 | 69 |

A* Bis(2-hydroxyethyl)tallow fatty amine N-oxide (50% solution)
B* $C_8/C_{10}$ alkyl glucoside (70% solution)
C* Dipropylene glycol monomethyl ether

TABLE 2

Dynamic Brookfield Viscosity in mPas

| | Comp.1 | Comp.2 | Comp.3 | Comp.4 | Comp.5 | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|---|---|---|---|---|
| Concentrate | 1300 | 125 | 5380 | 133 | 4730 | 5 | 5 | 5 | 3 | 9 | 3 | 11.8 | 86 | 78 | 25 |
| 10% in water | 33 | 32 | 51 | 71 | 63 | 42 | 64 | 71 | 39 | 63 | 35 | 22.5 | 110 | 130 | 154 |
| 5% in water | 68 | 8 | 40 | 69 | 53 | 13 | 12 | 51 | 4 | 14 | 9 | 76.8 | 130 | 12 | 83 |

The invention claimed is:

1. A process of cleaning a vertical or inclined hard surface, said process comprising a step of applying to said hard surface a cleaning solution that consists of a solution in water of from 2 to 10% by weight of a concentrated cleaning formulation comprising:

(a) 0.5 to 10% by weight of one or more tertiary amine oxides corresponding to general formula

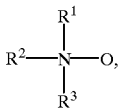

(I)

in which $R^1$ is a saturated or mono- to tri-unsaturated alkyl moiety containing 10 to 20 carbon atoms and $R^2$ and $R^3$ independently of one another represent methyl, ethyl or propyl moieties or hydroxy derivatives thereof;

(b) 0.5 to 10% by weight of one or more alkyl polyglycosides corresponding to general formula (II):

$$R^4—O—(R^5—O)_y(Z)_x, \quad (II)$$

in which $R^4$ is a monofunctional saturated or unsaturated alkyl or hydroxyalkyl moiety containing 6 to 30 carbon atoms or an aryl moiety, $R^5$ is a difunctional hydrocarbon moiety containing 2 to 4 carbon atoms, y is a number of 0 to 12, Z is a sugar moiety containing 5 or 6 carbon atoms and x is a number of 1 to 10;

(c) 1 to 15% by weight of one or more water-soluble organic solvents selected from the group of monohydric or polyhydric alcohols, glycol ethers and alkanolamines and for the balance water or an aqueous solution of other auxiliaries and active substances, said cleaning solution having a higher viscosity than said concentrated cleaning formulation, so that said cleaning solution, after it has been applied to said vertical or inclined hard surface to be cleaned, remains in contact with said vertical or inclined hard surface for a longer time.

2. A process according to claim 1, wherein the cleaning formulation is mixed with water in a mixing nozzle to form said cleaning solution before being applied to said hard surface.

3. A process according to claim 1, wherein the cleaning formulation is mixed with water to form the cleaning solution and thereafter the cleaning solution is manually applied to said hard surface.

4. A process according to claim 1, wherein, in said concentrated cleaning formulation, the ratio by weight of component (a) to component (b) to component (c) is 3:(1 to 5):(1 to 10).

5. A process according to claim 1, wherein said concentrated cleaning formulation contains: an amine oxide corresponding to general formula (I) when $R^1$ is a saturated or monounsaturated alkyl moiety containing 14 to 18 carbon atoms and $R^2$ and $R^3$ are 2-hydroxyethyl moieties; an alkyl polyglycoside corresponding to general formula (II), when $R^4$ is a saturated or unsaturated alkyl moiety containing 8 to 16 carbon atoms and Z is a glucose moiety, y=0 and x is a number from 1 to 5; and an organic solvent selected from the group consisting of ethanol, n- and i-propanol, butanols, glycol, propane and butanediol, glycerol, diglycol, propyl and butyl diglycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl and propyl ether, dipropylene glycol methyl and ethyl ether, methoxy, ethoxy and butoxy triglycol, 1-butoxyethoxy-2-propanol, 3-methyl-3-methoxybutanol, propylene glycol t-butyl ether and mono-, di- and tri-ethanolamine and mixtures of these solvents.

6. A process according to claim 4, wherein said concentrated cleaning formulation comprises from 1 to 5% by weight of component (a), component (b), or both.

7. A process according to claim 6, wherein amine oxide component (a) is selected from amine oxide molecules that correspond to general formula (I) when at least one of the following two conditions is satisfied:

(1) $R^1$ is a saturated or monounsaturated alkyl moiety containing 14 to 18 carbon atoms; and (2) $R^2$ and $R^3$ are 2-hydroxyethyl moieties.

8. A process according to claim 7, wherein alkyl polyglycoside component (b) is selected from alkyl polyglycoside molecules that correspond to general formula (II) when $R^4$ is a saturated or unsaturated alkyl moiety containing 8 to 16 carbon atoms, Z is a glucose moiety, y=0, and x is a number from 1 to 5.

9. A process according to claim 8, wherein solvent component (c) is selected from the group consisting of ethanol, n- and i-propanol, butanols, glycol, propane and butanediol, glycerol, diglycol, propyl and butyl diglycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl and propyl ether, dipropylene glycol methyl and ethyl ether, methoxy, ethoxy and butoxy triglycol, 1-butoxyethoxy-2-propanol, 3-methyl-3-methoxybutanol, propylene glycol t-butyl ether and mono-, di- and tri-ethanolamine and mixtures of these solvents.

10. A process according to claim 1, wherein said concentrated cleaning formulation comprises from 1 to 5% by weight of component (a), component (b), or both.

11. A process according to claim 10, wherein amine oxide component (a) is selected from amine oxide molecules that correspond to general formula (I) when at least one of the following two conditions is satisfied:

(1) $R^1$ is a saturated or monounsaturated alkyl moiety containing 14 to 18 carbon atoms; and (2) $R^2$ and $R^3$ are 2-hydroxyethyl moieties.

12. A process according to claim 10, wherein alkyl polyglycoside component (b) is selected from alkyl polyglycoside molecules that correspond to general formula (II) when $R^4$ is a saturated or unsaturated alkyl moiety containing 8 to 16 carbon atoms, Z is a glucose moiety, y=0, and x is a number from 1 to 5.

13. A process according to claim 12, wherein solvent component (c) is selected from the group consisting of ethanol, n- and i-propanol, butanols, glycol, propane and butanediol, glycerol, diglycol, propyl and butyl diglycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl and propyl ether, dipropylene glycol methyl and ethyl ether, methoxy, ethoxy and butoxy triglycol, 1-butoxyethoxy-2-propanol, 3-methyl-3-methoxybutanol, propylene glycol t-butyl ether and mono-, di- and tri-ethanolamine and mixtures of these solvents.

14. A process according to claim 1, wherein amine oxide component (a) is selected from amine oxide molecules that correspond to general formula (I) when at least one of the following two conditions is satisfied:

(1) $R^1$ is a saturated or monounsaturated alkyl moiety containing 14 to 18 carbon atoms; and (2) $R^2$ and $R^3$ are 2-hydroxyethyl moieties.

15. A process according to claim 14, wherein alkyl polyglycoside component (b) is selected from alkyl polyglycoside molecules that correspond to general formula (II) when $R^4$ is a saturated or unsaturated alkyl moiety containing 8 to 16 carbon atoms, Z is a glucose moiety, y=0, and x is a number from 1 to 5.

16. A process according to claim 15, wherein solvent component (c) is selected from the group consisting of ethanol, n- and i-propanol, butanols, glycol, propane and butanediol, glycerol, diglycol, propyl and butyl diglycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl and propyl ether, dipropylene glycol methyl and ethyl ether, methoxy, ethoxy and butoxy triglycol, 1-butoxyethoxy-2-propanol, 3-methyl-3-methoxybutanol, propylene glycol t-butyl ether and mono-, di- and tri-ethanolamine and mixtures of these solvents.

17. A process according to claim 1, wherein alkyl polyglycoside component (b) is selected from alkyl polyglycoside molecules that correspond to general formula (II) when $R^4$ is a saturated or unsaturated alkyl moiety containing 8 to 16 carbon atoms, Z is a glucose moiety, y=0, and x is a number from 1 to 5.

18. A process according to claim 17, wherein solvent component (c) is selected from the group consisting of ethanol, n- and i-propanol, butanols, glycol, propane and butanediol, glycerol, diglycol, propyl and butyl diglycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl and propyl ether, dipropylene glycol methyl and ethyl ether, methoxy, ethoxy and butoxy triglycol, 1 -butoxyethoxy-2-propanol, 3-methyl-3-methoxybutanol, propylene glycol t-butyl ether and mono-, di- and tri-ethanolamine and mixtures of these solvents.

19. A process according to claim 1, wherein solvent component (c) is selected from the group consisting of ethanol, n- and i-propanol, butanols, glycol, propane and butanediol, glycerol, diglycol, propyl and butyl diglycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl and propyl ether, dipropylene glycol methyl and ethyl ether, methoxy, ethoxy and butoxy triglycol, 1-butoxyethoxy-2-propanol, 3-methyl-3-methoxybutanol, propylene glycol t-butyl ether and mono-, di- and tri-ethanolamine and mixtures of these solvents.

20. A process according to claim 1, comprising an additional step of washing the cleaning solution from the vertical or inclined hard surface with water after a desired period of contact between the cleaning solution and the hard surface.

* * * * *